United States Patent [19]

Pischinger et al.

[11] Patent Number: 4,614,170

[45] Date of Patent: Sep. 30, 1986

[54] METHOD OF STARTING A VALVE REGULATING APPARATUS FOR DISPLACEMENT-TYPE MACHINES

[75] Inventors: Franz Pischinger; Peter Kreuter, both of Aachen, Fed. Rep. of Germany

[73] Assignee: Fev Forschungsgesellschaft fur Energietechnik und Verbrennungsmotoren mbH, Aachen, Fed. Rep. of Germany

[21] Appl. No.: 585,182

[22] Filed: Mar. 1, 1984

[30] Foreign Application Priority Data

Mar. 1, 1983 [DE] Fed. Rep. of Germany ..... 3307070

[51] Int. Cl.[4] ..... F01L 9/04

[52] U.S. Cl. ..... 123/90.11; 251/129.1

[58] Field of Search ..... 123/90.11, 90.65; 251/129.01, 129.1

[56] References Cited

U.S. PATENT DOCUMENTS

| | | | |
|---|---|---|---|
| 1,096,955 | 5/1914 | Rock | 123/90.11 |
| 1,471,861 | 10/1923 | Perrault | 123/90.11 |
| 1,474,842 | 11/1923 | Misuraca | 123/90.11 |
| 2,468,917 | 5/1949 | Booth | 123/90.11 |
| 3,741,176 | 6/1973 | Schmidt et al. | 123/90.11 |

FOREIGN PATENT DOCUMENTS

| | | | |
|---|---|---|---|
| 2063158 | 6/1972 | Fed. Rep. of Germany | 123/90.11 |
| 2335150 | 1/1974 | Fed. Rep. of Germany . | |
| 2630512 | 1/1978 | Fed. Rep. of Germany | 123/90.11 |
| 2815849 | 10/1979 | Fed. Rep. of Germany | 123/90.11 |
| 3024109 | 1/1982 | Fed. Rep. of Germany . | |
| 563755 | 6/1957 | Italy | 123/90.11 |
| 153915 | 9/1982 | Japan | 123/90.11 |
| 183805 | 10/1983 | Japan | 123/90.11 |

*Primary Examiner*—Ira S. Lazarus

*Attorney, Agent, or Firm*—Watson, Cole, Grindle & Watson

[57] ABSTRACT

A method and apparatus for starting and regulating valve systems for displacement-type machines such as fuel-regulated internal combustion engines wherein a valve can be held in at least two final operational positions. The valve systems are each designed as an oscillating spring/mass system such that periodic force components or travel path excitations can be communicated to the spring/mass system in its original starting position or in a static home position. The pulse characteristics or frequency of the force components or excitations are close or equal to the natural frequency of each spring/mass valve system, so that the valve system is caused to oscillate with an increasing amplitude and is thus excited into one of the two final operational positions.

10 Claims, 5 Drawing Figures

METHOD OF STARTING A VALVE REGULATING APPARATUS FOR DISPLACEMENT-TYPE MACHINES

BACKGROUND OF THE INVENTION

1. Field of the Invention

This invention relates to a method for starting and regulating electromechanical valve adjusting devices for displacement-type machines and more particularly for starting and regulating valve actuating devices particularly suitable for operating valves or valve slides in internal combustion engines. The valve actuating devices are controlled by a control unit to set the dwell time of valves maintained in operating positions by any corresponding desired excitation time of an electromagnet triggered by the control unit.

2. Description of the Prior Art

A problem associated with starting internal combustion engines is that in order to initially start electromechanical valve adjusting devices such as disclosed in our copending Application entitled "Method of Controlling Reciprocating Four-Stroke Internal Combustion Engines", filed Feb. 3, 1984, under U.S. patent application Ser. No. 576,896 one must resort to special techniques to execute relatively large valve strokes with a high operating frequency. In Unexamined West German Patent Specification DE-OS No. 23 35 150, this problem is addressed with two dipping armature magnets, which results in a heavy form of construction and in relatively inefficient operating frequencies per mass unit of the armatures, so that only relatively low operating frequencies can be attained. Another possibile solution relies upon the use of very high currents for the starting process. However, this calls for very high starting voltages far above the standard operating starting voltages. The use of a very high voltage both for starting or initiating the valve control or adjusting process and for the subsequent operation of the valves during normal engine operational modes requires a limitation of the operating current with a series resistance. This results in a considerable power reduction during normal engine operation. According to U.S. Pat. No. 4,455,543, starting is accomplished with an additional biasing system.

SUMMARY OF THE INVENTION

A major object of the invention is to effect engine starting and the associated valve actuation without using techniques of the kind described hereinabove and without limiting the working stroke of the valve and the attainable operating valve frequencies. This object is achieved by a method and apparatus for initiating or starting valve regulating devices in internal combustion engines having a valve adapted to be held in first and second operating positions with first and second electromagnets, respectively. Each valve is further adapted to be held in a static home or rest position and is designed as a part of a spring-mass valve actuating and regulating system. The system has a predetermined natural frequency of oscillation and is caused to oscillate with an increasing amplitude by a periodically alternating force component applied to the system with a frequency close to the natural frequency of the spring-/mass system. The force is periodically applied until the deflection of the valve from its static home position is so great that at least one of the electromagnets is able to hold the spring/mass system in one of the operating positions, thereby enabling the valve regulating device to become operational.

To terminate the starting process successfully, several possibilities within the scope of the invention come into consideration. Upon attaining a maximum amplitude, which is defined by the maximum working stroke of the valve, the armature of the electromagnet which first contacts the magnet coils causes the current in the coils of the electromagnet to be changed. As a control signal this current change is suitable for terminating the periodic excitation of the system and for keeping the armature in one of the desired operating positions typically associated with an open or closed valve when the current pattern in the coils changes for the first time or at a later time. Another advantageous possibility includes carrying out a predetermined sufficiently large number of periodic excitations in order to ensure maximum amplitude, then holding the armature in a desired operating position.

In starting equipment of the type provided by the invention, periodically alternating forces are imparted in one or in both directions of movement of the spring-/mass system, whereby forces act on the armature in the static home position of the spring/mass system in such a manner that the system can be excited at its natural frequency. If this type of regulating device is used for the control of the gas exchange in displacement-type machines with moving pistons, then unlike stationary pistons, pressure differences arise on the slides or on the valves which might hinder the starting process. In this instance, two valves associated with a cylinder can be operated such that a first valve is left in a static home half opened position, so that the gas can flow in and out of the cylinder in accordance with the piston movement such that no appreciable pressure differences arise, while the second valve attains its operational status in an open position in a manner taught by the invention. In this way, the gas exchange remains substantially unaffected by pressure so that subsequently the first valve will also attain its operational status in the manner proposed by the invention. If a first valve is to be set up for operation before a second valve, the first valve will be brought to its open position before the second valve can attain its operational status in the manner taught by the invention.

The advantages of this type of starting system are seen in the reduced design requirements for starting up the valve regulating device with undiminished capacity with respect to attainable valve strokes, operating frequency and attainable forces of the electromagnets.

BRIEF DESCRIPTION OF THE DRAWINGS

The approach proposed by the invention for solving the starting problem outlined above will now be described with reference to the specific embodiments illustrated in the drawings. Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

Figure 1:
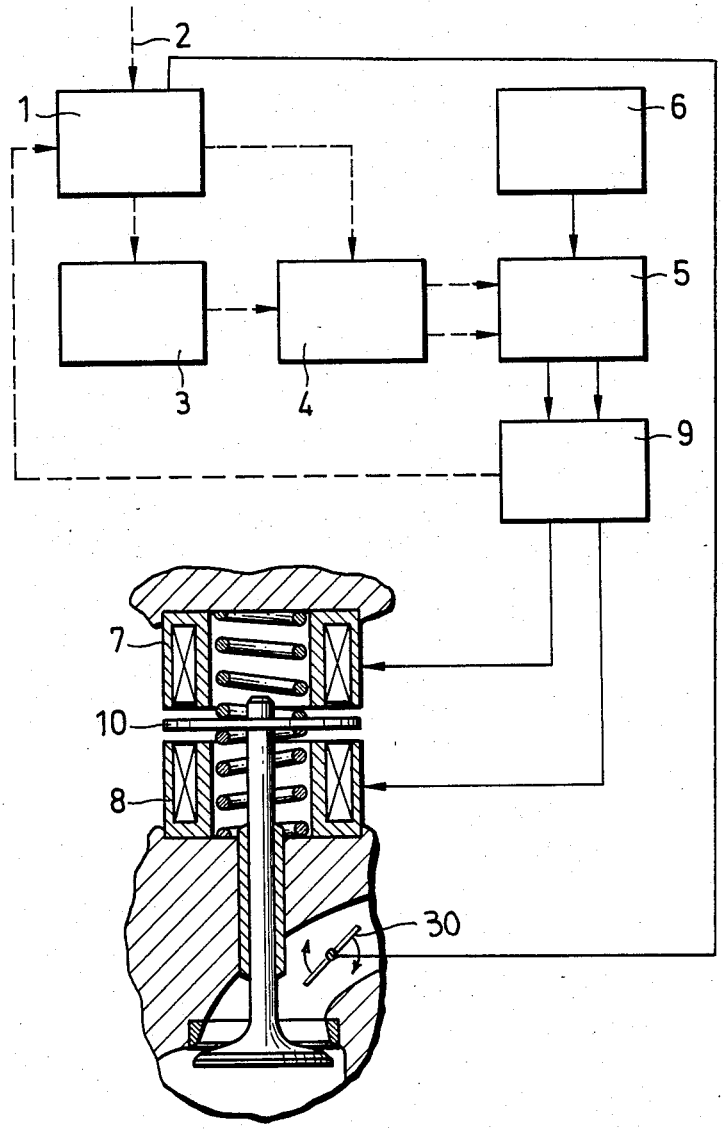
FIG. 1 shows a partial section of a cylinder head of an internal combustion engine together with a block diagram of the electrical system for valve control.

FIG. 1 is a schematic illustration of the starting system embodying the invention as exemplified by an internal combustion engine. A control unit 1, e.g., a microprocessor, fed with input 2 for a start command, triggers a frequency generator 3 in order to produce required valve actuating frequencies. Control unit 1 further triggers a switch 4 which transmits the frequencies of the frequency generator 3 to an amplifier 5 or which supplies the amplifier with a valve holding signal to hold the valve in a predetermined position based upon logic decisions computed by the microprocessor 1.

The amplifier 5 supplies the electromagnets 7 and 8 of the valve regulating device with energy from the energy source 6 which may take the form of a battery. The electromagnets 7 and 8 act on and attract the armature 10 with electric energy corresponding in duration to the trigger signals of the switch 4 and, in the process, quantitative information concerning the current flowing through the coils of the electromagnets 7 and 8 is supplied to the control unit 1 by the sensor 9.

Figure 2:
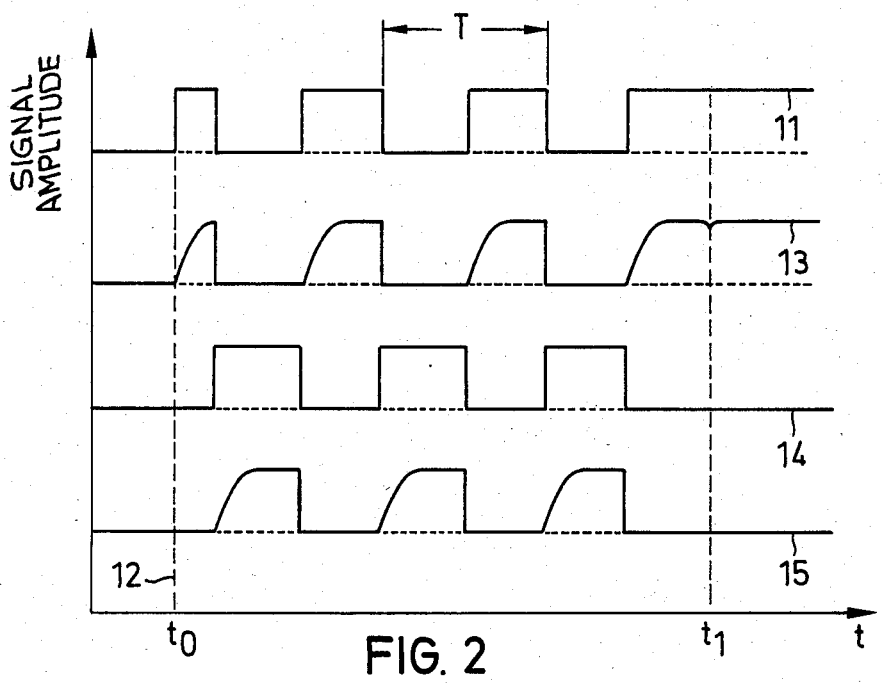
FIG. 2 graphically illustrates the valve actuating signals at the amplifier input of the electric control system and diagrams the current flowing through the coils of the electromagnets used for the valve control.

FIG. 2 illustrates the signals appearing at the input side of the amplifier 5 as well as the currents in the coils of both electromagnets 7 and 8 as a function of time, t. Line 11 represents the signals conducted from the switch 4 to the amplifier 5 for the purpose of triggering electromagnet 7. The amplifier stage 5 for the electromagnet 7 is not triggered before the starting instant $t_o$ represented by line 12.

The initial starting process begins with the excitation of the electromagnet 7 from the starting moment $t_o$ for about one-quarter of the natural oscillating time period T of the spring/mass system of the valve adjusting or regulating device. This is followed with the alternate triggering or non-triggering of the amplifier stage 5 for the electromagnet 7, as indicated by the further signal run along line 11 for periods of one-half of the oscillation time T.

Line 13 of FIG. 2 shows the current flowing through the coil of the electromagnet 7 as a result of the triggering indicated by line 11 and as modified by the inductance of the electromagnet 7. Sensor 9 quantitatively measures this current and sends a corresponding signal to control unit 1. Shortly before the instant $t_1$, the path of the current flowing through the coil of the electromagnet 7 changes when compared with previous cycles because of the action of the armature 10. That is, armature 10 touches the electromagnet 7 for the first time at $t_1$ when the oscillation amplitude of the spring/mass system eventually reaches the area of the valve operating positions wherein the valve is held in an open or closed position by magnetic force between the armature 10 and electromagnet 7.

The current flowing through electromagnet 7 diminishes briefly at time $t_1$ due to the higher energy content of the electromagnet 7. This current reduction is sensed by current flow sensor 9 and is interpreted by the microprocessor control unit 1 as the attainment of an adequate oscillation amplitude. Thereafter, the periodic excitation of the electromagnets 7 and 8 under normal operating conditions is initiated. The armature 10 is initially maintained and held at time $t_1$ against the electromagnet 7 which is then constantly excited on a non-permanent operational basis. This causes the valve regulating device to attain its operational status, so that the amplifier 5 can be further triggered in conformity with the regulating command instructions generated in control unit 1.

The above description is applicable to the initiation of the starting process without using the electromagnet 8. If the electromagnet 8 is also to be used for the starting procedure, another signal flow pattern as shown by line 14 in FIG. 2 is conducted to the amplifier 5 which supplies the electromagnet 8 with electric energy, and a current starts to flow through the electromagnet 8. This signal flow for the triggering of the electromagnet 8 is shifted by one-half of the oscillation time period T with respect to the signal flow for the triggering of the electromagnet 7.

Line 15 represents the current flowing through the coil of electromagnet 8 as a result of the triggering indicated by line 14 and as modified by the inductance of electromagnet 8. From the instant $t_1$ on, the electromagnet 8 can be triggered as required by the control logic function of the regulating command instructions generated in control unit 1.

The above-described functions of the electromagnets are interchangeable. That is, electromagnet 8 may be triggered alone with electromagnet 7 remaining inactive. Another starting method provides for communicating the pulsed forces at an initial frequency different from the natural oscillatory frequency of the spring/mass valve system and modulating the frequency of the pulsed forces so that they approach the natural frequency of the spring/mass valve system. In addition, if any other valve systems are present in the engine, they may be maintained in an unexcited deactivated state until the first valve system becomes operational, at which time an additional system may be excited in accordance with the starting procedure set forth above. Furthermore, once a valve has been brought to a final operational position, it can be maintained in an open final position to facilitate the starting process for any additional valve systems.

Figure 3:
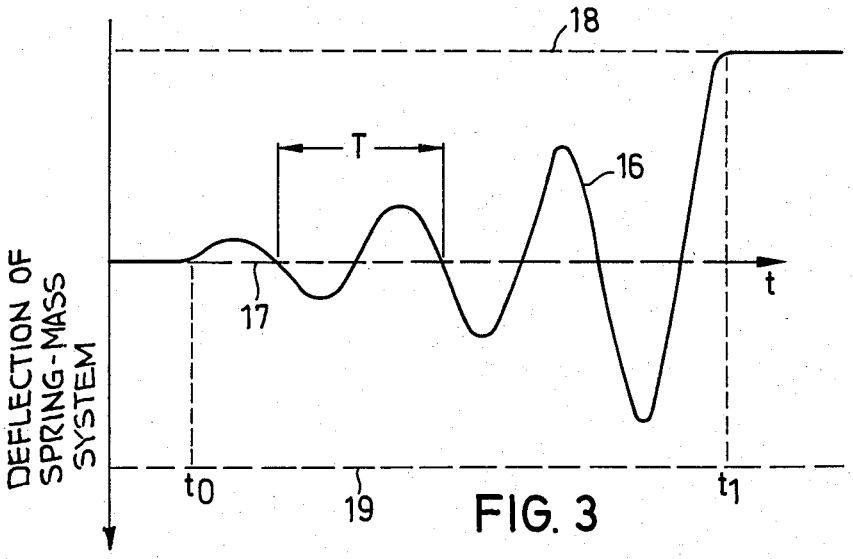
FIG. 3 is a diagram illustrating the oscillatory behavior of the moving masses of the spring/mass system over time.

FIG. 3 depicts as a function of time, t, the oscillation displacement curve of the moving masses of the spring/mass system as indicated by line 16. A non-operational or static engine valve condition exists prior to time $t_0$. An operational engine status is attained after time $t_1$ via the starting phase which extends from to $t_0 t_1$, as a result of the periodic excitation of the electromagnets 7,8 as shown in FIG. 2.

During the starting phase, the oscillation amplitude of the spring/mass system increases due to the periodic force components provided by the electromagnets over the time $t_0$ to $t_1$ until the deflection from the static home position indicated by the dotted line 17 is so great that the maximum deflection possible in one direction, as illustrated by the dotted lines 18 and 19, is attained at time $t_1$. From this instant on, the spring/mass system can be held in a fixed position via the armature 10 either by electromagnet 7 or by electromagnet 8 by maintaining the current intensity through the respective electromagnet for as long as required. The number of oscillations required to reach the maximum amplitude for the first time depends on the particular valve regulating device concerned and is shown by way of example with an arbitrarily chosen oscillation frequency.

Figure 4:
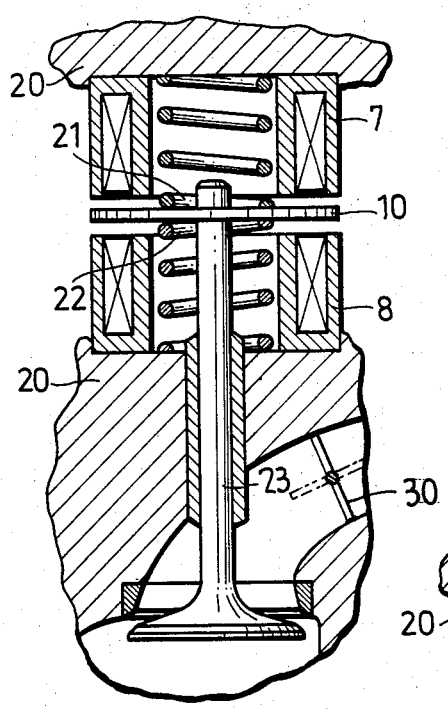
FIG. 4 is a partial section view of a cylinder head of an internal combustion engine in which the spring/mass system of a closing valve is in a home intermediate position.

FIG. 4 shows the electromagnet valve actuating device, with the spring/mass system in a static home position. The electromagnets 7 and 8 are held in position by the housing 20. The springs 21 and 22 act on the moving masses and bear on the housing 20. Armature 10 and valve 23 are in the static home position and contribute to the mass of the spring/mass system.

Figure 5:
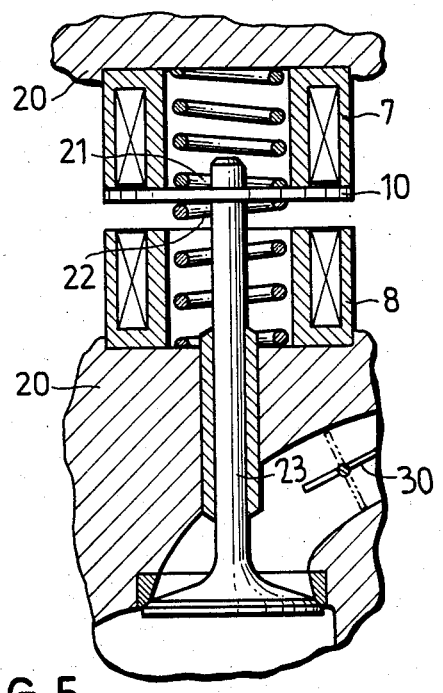
FIG. 5 is a partial section corresponding to FIG. 4 with the valve closed in an operational position.

FIG. 5 shows the electromagnetic valve regulating device in an operational status with the valve 23 closed after a successfully completed starting process. In the present case the moving masses comprise valve 23, armature 10 and the moving parts of springs 21 and 22. The typical natural frequency of the spring/mass system may be expected to occur in the range of 5 through 1000 hz, as the case may be.

It can be seen from FIG. 4 that when the spring/mass system is in a static home position as shown, the valve 23 is held in a half-closed position, for example during periods when the valves are not in use. In a valve-controlled internal combustion engine all the valves will be held in such position during engine down times. This condition has the drawback that unwanted corrosion phenomena can arise during relatively long periods of valve inactivity. Therefore, the invention provides for a blocking element 30 in the intake and exhaust system which, for example, is triggered by the control unit 1 in such a way that the blocking element closes when the machine is at a standstill, and opens when the machine is put into operation.

The invention is not limited to the particular embodiments shown and described herein. Thus, it can also be applied to slide controls or other controls, and it offers considerable advantages not only to engines but also to compressors. As a rule, it can be used to advantage for putting into operation engines in which at least one functional element is movable against the action of opposing resilient means by force components or travel path excitations between at least two final positions from an initial position or from an intermediate static home position located between the final positions.

Instead of periodic force components, one can also communicate to the system periodic path excitations which are independent of the reactionary forces of the oscillating spring/mass system, e.g., by mechanical means, such as eccentrics or cams rotating at an appropriate speed, or by appropriate hydraulic means.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Adjusting apparatus for a gas exchange valve of an internal combustion engine capable of being set in either of two terminal positions with an electro-magnet system which holds the valve in one of said terminal positions, a substantially disc-shaped armature connected with said valve which, when said electro-magnet system is deactivated, is held by the spring tension of springs at a static or rest position between said two terminal positions, said valve, springs, armature and electro-magnet system comprising an oscillatable spring-mass system having a predetermined natural frequency of oscillation, the improvement wherein means are provided for applying periodic pulsed force to said spring-mass system when in said static or rest position, the frequency of the pulsed forces being approximate to the natural frequency of oscillation of said spring-mass system so that said valve is induced to execute oscillations of increasing amplitude until one of said terminal positions is reached at which the adjusting apparatus achieves operational readiness.

2. The apparatus according to claim 1, wherein said means for applying said periodic pulsed forces comprises said electro-magnet system fed by electrical impulses.

3. The apparatus according to claim 2, wherein said electro-magnet system comprises a pair of electro-magnets disposed at a distance from one another at said terminal positions of said valve.

4. Process for achieving operational readiness of an adjusting apparatus for a gas exchange valve of an internal combustion engine capable of being set in either of two terminal positions with an electro-magnet system which holds the valve in one of said terminal positions, a substantially disc-shaped armature connected with said valve which, when said electro-magnet system is deactived, is held by the spring tension of springs at a static or rest position between said two terminal positions, said valve, springs armature and electro-magnet system comprising an oscillatable spring-mass system having a predetermined natural frequency of oscillation, the process comprising the step of, while in said static or rest position, applying periodic pulsed forces to said spring-mass system at a frequency which approximates the natural frequency of oscillation of said spring-mass system so that said valve is induced to execute oscillations of increasing amplitude until one of said terminal positions is reached at which the operational readiness is achieved.

5. The process according to claim 4, wherein said electro-magnet system, fed by electrical impulses, applies said periodic pulsed forces.

6. The process according to claim 5, wherein said electro-magnet system comprises a pair of electro-magnets disposed at a distance from one another at said terminal positions of said valve.

7. The process according to claim 6, comprising the step of feeding said electrical impulses to only one of said electro-magnets.

8. The process according to claim 6, comrising the step of feeding said electrical impulses to both of said electro-magnets, and dephasing said impulses fed to one of said electro-magnets by half of the time interval between impulses in relation to said impulses fed to the other of said magnets.

9. The process according to claim 4, comprising the steps of initially removing the frequency of the pulsed forces from the natural frequency of said spring-mass system and adapting the removed frequency to the natural frequency of said spring-mass system while said valve moves from said rest position to said one terminal position.

10. The process according to claim 9, wherein the step of applying includes applying a fixed number of the pulsed forces as said valve moves from said rest position to said one terminal position.

* * * * *